US006675615B1

(12) United States Patent
Williams

(10) Patent No.: US 6,675,615 B1
(45) Date of Patent: Jan. 13, 2004

(54) T-BAR DECK LOCKER SECURITY SYSTEM

(76) Inventor: J. Mark Williams, 619 Calicos Ct., Wilmington, NC (US) 27616

( * ) Notice: Subject to any disclaimer, the term of this patent is extended or adjusted under 35 U.S.C. 154(b) by 0 days.

(21) Appl. No.: 10/079,220

(22) Filed: Feb. 14, 2002

Related U.S. Application Data

(63) Continuation-in-part of application No. 09/595,132, filed on Jun. 16, 2000.

(51) Int. Cl.[7] ..... B65D 55/14

(52) U.S. Cl. ..... 70/164; 70/14; 70/19; 70/57; 70/58; 292/1.1; 292/37.1; 292/288

(58) Field of Search ..... 70/164, 57, 58, 70/163, 14, 19, 94; 292/288, 289; 296/1.1, 37.1

(56) References Cited

U.S. PATENT DOCUMENTS 2,892,495 A * 6/1959 Hadden ..... 70/164
3,797,005 A * 3/1974 Scwarz ..... 340/274
4,318,559 A * 3/1982 Burton ..... 292/263
5,010,747 A * 4/1991 Norden ..... 70/94
5,022,697 A * 6/1991 Hettwer ..... 292/37.6
5,299,721 A * 4/1994 Cummings ..... 224/42.42
5,340,172 A * 8/1994 Sweet ..... 292/259 R
5,343,722 A * 9/1994 Richardson ..... 70/259
5,439,210 A * 8/1995 Davis ..... 273/1.5 R
5,466,023 A * 11/1995 Williamson ..... 292/259 R
5,927,107 A * 7/1999 Mitchell ..... 70/14

* cited by examiner

*Primary Examiner*—J. J. Swann
*Assistant Examiner*—Carlos Lugo
(74) *Attorney, Agent, or Firm*—Mills Law Firm, PLLC

(57) ABSTRACT

A T-bar lockable linkage between the gunnels and forward of a marine craft limits opening of side and central storage containers. The linkage includes a pair of tubular outer arms independently pivotally connected to a center link having an extended position for connection to the mounting brackets and a shortened position for removal therefrom. A shiftable lock block slidably supported on the linkage effects rigidized coaxial alignment of the outer arms in the extended position, The lock block includes a locking hub for releasable connection with a transverse center arm for limiting opening of the storage containers. The hub carries a keyed locking device including a latch bolt that engages the cross arm assembly to unitize the assembly and prevent separation of the components.

14 Claims, 11 Drawing Sheets

T-BAR DECK LOCKER SECURITY SYSTEM

RELATED APPLICATION

This application is a continuation-in-part application of U.S. Ser. No. 09/595,132 filed on Jun. 16, 2000 and entitled "T-Bar Deck Locker Security System".

FIELD OF THE INVENTION

The present invention relates to secured storage systems for marine craft and, in particular, to a security system kit for protecting the contents of storage lockers on the deck of a sport fishing boat.

BACKGROUND OF THE INVENTION

Recreational sport fishing is an extremely popular activity for many outdoor enthusiasts. Bass fishing in particular has an extensive following and many specialized marine products have been developed to assist the angler in pursuit of these selective, combative and challenging fish. Special craft know specifically as bass boats have been developed to take the angler to the varying environments of the bass and provide stable platforms for fishing. Additionally extensive, specialized gear and accessories have been developed for fully outfitting the boat and the angler for the activity.

Such gear generally includes a variety of poles and reels, specialized tools, tackle and lures, and bait, cooling and storage containers for the catch, life jackets, sporting attire and related paraphernalia that may be stored separately on board. However, all of the foregoing items are valuable and subject to pilferage when the boat is unattended, docked, transported or otherwise unattended. To provide greater organization and security, specialized lockable containers have become available. However, such individual containers are not readily stowed or organized compactly and efficiently. Moreover, the construction of such containers, usually lighter weight material such a plastics, does not provide substantial deterrence to pilferage. Increasingly, bass boat manufacturers and accessory supplies have provided customized, integrated storage lockers into the boat design. One example of such an approach is disclosed in U.S. Pat. No. 5,975,002 to Reiger wherein a plurality of fore and aft storage containers are integrated into the boat construction. Such containers include side containers adjacent the gunnels for rods and reels and center containers for tackle, lures, bait and catch. Generally, the containers are fabricated from plastic and covered by hinged or removable lids. While cover securing devices are employed, substantial deterrence to entry and theft is not afforded.

In order to provide greater deterrence to theft, more secure locking systems have been proposed. In U.S. Pat. No. 5,927,107 to Mitchell, a locking device comprising telescoping pipes is supported between fixed brackets on the gunnels of the boat. The pipes overlie the container lids and limit opening movement thereof to deter pilferage. The inner pipe includes a series of series of through holes. A padlock link is inserted through the hole nearest the outer pipe to prevent removal of the pipes from the brackets. While providing deterrence to theft from the side boxes, the proposed device required specialized mounting brackets to adapt to varying boat configurations. Moreover, unless accurately aligned, connection with the cross pipes was difficult. Additionally, the regular spacing of the locking holes can result in assembled conditions with sufficient side movement to reduce the capture of the cross pipes and facilitate dislodging of the device. Furthermore, the locking device is effective only against side containers and center containers directly beneath the cross pipes. Inasmuch as many boat designs include a plurality of center containers, the remainder is left unprotected. In my pending application, U.S. Ser. No. 09/595,132 filed on Jun. 16, 2000, a center T-bar is connected at a central hub with a crossbar for additionally protecting the center containers. The system provides a substantial increase in the security for the containers against certain types of vandalism and forced entry. The center bar telescoping components, however, even when disassembled, are lengthy presenting storage difficulties when not is use. Further, like the foregoing constructions, the system may be compromised by cutting the protective tubes and bars.

In view of the foregoing limitations, a need continues to exist for a comprehensive, readily deployed and stowed security system for boat storage lockers that can accommodate widely varying boat designs and protect from theft and pilferage the angler's valuable possessions.

Accordingly it is an object of the present invention to provide a lockable security system for providing security to an array of storage lockets in a marine craft with a single device.

Another object of the invention is to provide a security system for storage lockers of marine craft that can be readily installed in boats of varying configurations, and readily disassembled and compactly towed onboard.

A further object of the invention is to provide a security system for side and center storage containers in boats effective against forced and destructive entry.

Yet another object of the invention is to provide a storage locker security kit that may be custom installed on varying boat designs and is effective against pilferage of contents held in a plurality of side and center storage lockers.

SUMMARY OF THE INVENTION

The foregoing objects are achieved by a storage locker security system in accordance with the invention by T-bar lockable linkage deployed between the gunnels and forward seating or casting area of a marine craft and effective to limit opening of an array of side and central storage containers. More particularly the security system comprises a transverse linkage and an intersecting center arm. The transverse linkage comprises a pair of outer arms pivotally connected to a center link coupling assembly. The transverse linkage may be shorted for alignment with mounting brackets at the sides of the front boat deck, and extended into coaxial alignment for capture by the brackets. A lock block is slidably mounted on the cross bar is shifted to a central position for rigidizing the linkage. A front anchor is releasably attached to the front pedestal base and slidably receives a center arm. With the center arm in place, the front anchor is conditioned against removal. The center arm is aligned with and closely overlies the center storage lockers and includes a terminal end that is received in a locking slot in the lock block and a projecting locating pin that is received in the transverse linkage thereby limiting relative movement therebetween and preventing disengagement from the mounting brackets. A lock assembly on the lock block includes latch bolt that engages the center arm to unitize the assembly and prevent separation of the components. The resultant assembly is readily installed, without specialized skills, on site with simple equipment. For removal, the center bar is removed, the lock block shifted to allow collapse of the transverse, and the linkage folded into compact juxtaposition. The disassembled components may be bundled for convenient compact storage. The cross bar linkage and the center bar of formed of tubular stock and carry therewithin rotatable roll bars. In the event the tubes are sawn, the saw teeth merely rotate the roll bar to defeat a complete severing of the component.

DESCRIPTION OF THE DRAWINGS

The above and other features and advantages of the present invention will become apparent upon reading the following detailed description taken in conjunction with the accompanying drawings in which.

DETAILED DESCRIPTION OF THE PREFERRED EMBODIMENTS

The present invention relates to storage security for marine craft and will be particularly described with reference to storage lockers for bass boats. However, it will be appreciated that the features, benefits and advantages of the storage security system will be afforded the varying types and sizes of bass boats and marine craft.

Figure 2:
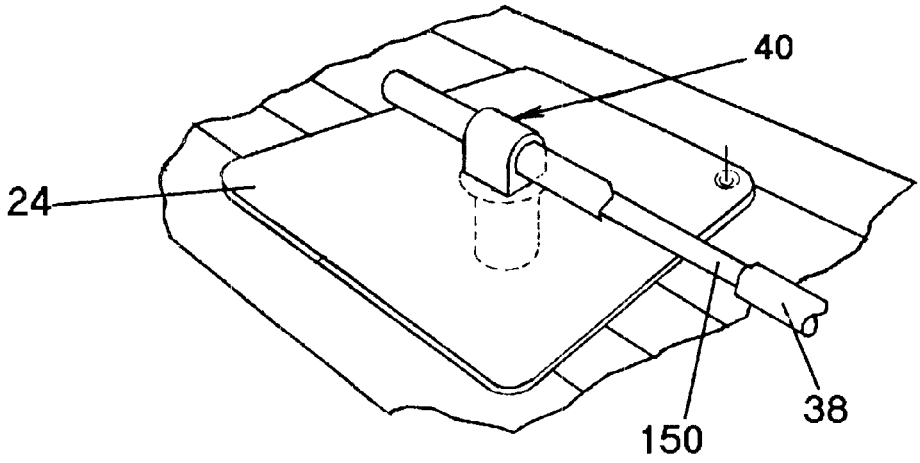
FIG. 2 is a fragmentary perspective view of the seat pedestal plate and anchor spindle of the deck locker security system shown in FIG. 1.
Figure 1:
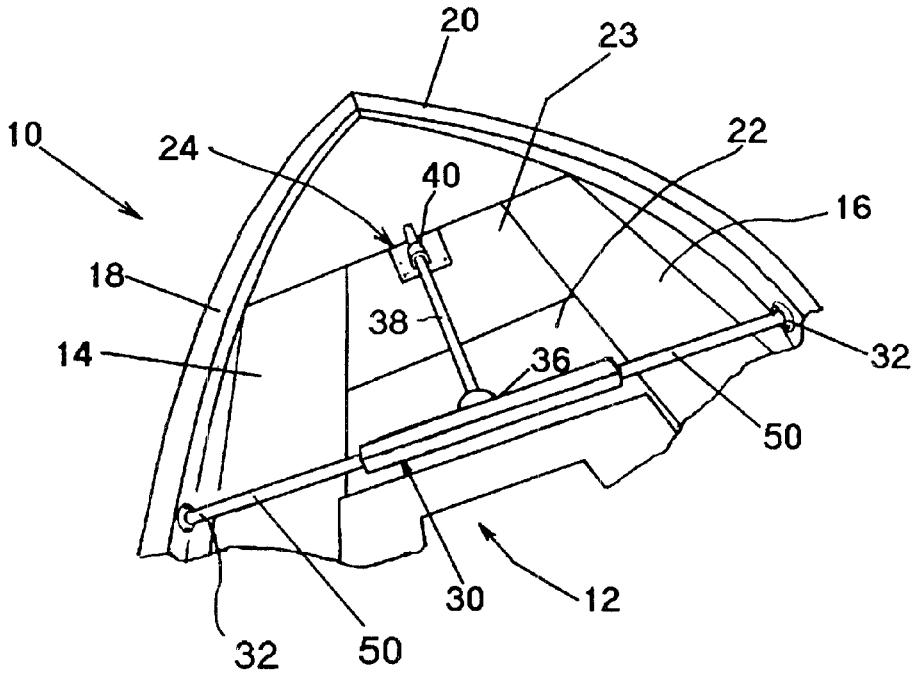
FIG. 1 is a partial perspective view of a deck locker security system in accordance with the present invention installed in the hull of a marine craft.

Referring to FIGS. 1 and 2, a bass boat 10 is provided with a T-bar deck locker security system 12 for limiting access to a plurality of covered storage containers in the hull of the boat including side lockers 14 and 16 located along the sides adjacent the gunnels 18, 20, and center lockers 22, 23 located therebetween. The illustrated boat is provided with a conventional removable swivel seat, not shown, operatively mounted at a front seat pedestal base 24 in the bow. As described below, the pedestal base may used in conjunction with the anchors of the security system as disclosed in my copending application U.S. Ser. No. 09/595,132 filed on Jun. 16, 2000. Alternatively, a separate frontal assembly may be employed.

The side lockers 14 and 16 are used primarily for housing and securing rods and tackle whereas the center lockers 22, 23 may be used for bait and game fish and supplies therefor. Inasmuch as the contents of the lockers are valuable and subject to pilferage, the security system 12 is deployed during docking, transporting or other times when the boat is unattended.

More particularly, the security system 12 comprises an articulated lateral cross arm assembly 30 closely overlying the side lockers 14, 16 and connected to side brackets 32 fixedly attached to the gunnels 18, 20 respectively, a lock block 36 slidably carried on the cross arm assembly 30, and a T-bar center arm 38 releasably coupled at in inner end to the lock block 36 and telescopically connected at the outer end to a anchor spindle 40 removably carried at the pedestal base 24. The center arm 38 overlies the center lockers 22, 23 generally orthogonal to the cross bar assembly 30. The security system 12, as deployed, is sufficiently closely adjacent the locker covers, whether hinged or removable, to prevent the opening thereof sufficiently to gain access to the stored contents thereof. Preferably the cross arm assembly 30 bisects the side lockers 14, 16 and the center arm 38 bisects the center lockers 22, 23. As hereinafter described in detail, the security system 12 may be readily deployed and latched for securing the lockers as desired, and readily disassembled and compactly stowed during fishing excursions.

Figure 4:
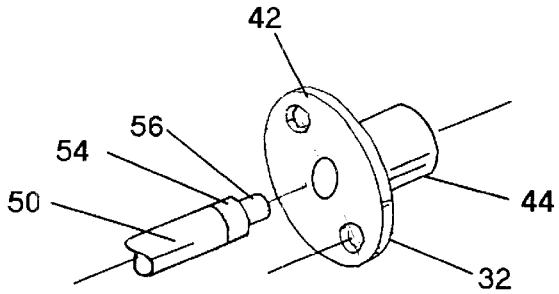
FIG. 4 is a perspective view of the side bracket and cross bar assembly.
Figure 5:
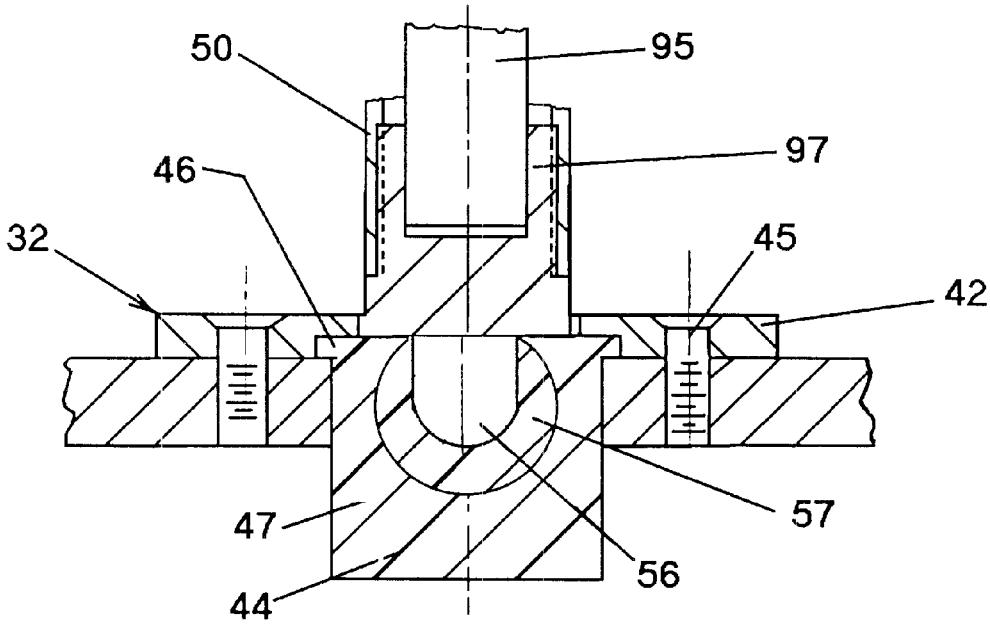
FIG. 5 is a cross sectional view of the mounting bracket and cross arm assembly.

Referring to FIGS. 4 and 5, the articulated cross arm assembly 30 is transversely disposed with respect to the keel of the boat 10 and removably fixedly connected with the brackets 32 in the latched condition. Each bracket is similar in construction. The brackets 32 include a front mounting plate 42 carrying a cylindrical sleeve 44. The sleeve 44 is received in a complementary opening formed in the adjacent gunnel 18 and the bracket 32 attached thereto by fasteners 45. The rear surface of the mounting plate 40 includes a counter bore for receiving a front annular flange 46 of the sleeve. The sleeve 42 is formed of a flexible polymeric material having a cast-in ball 57 with an inwardly opening counter bore 47, coaxial with the counterbore in the mounting plate 42 for receiving the outboard end tip of the cross arm assembly, as described below. The ball 57 accommodates limited angular positioning variations in mounting.

Figure 7:
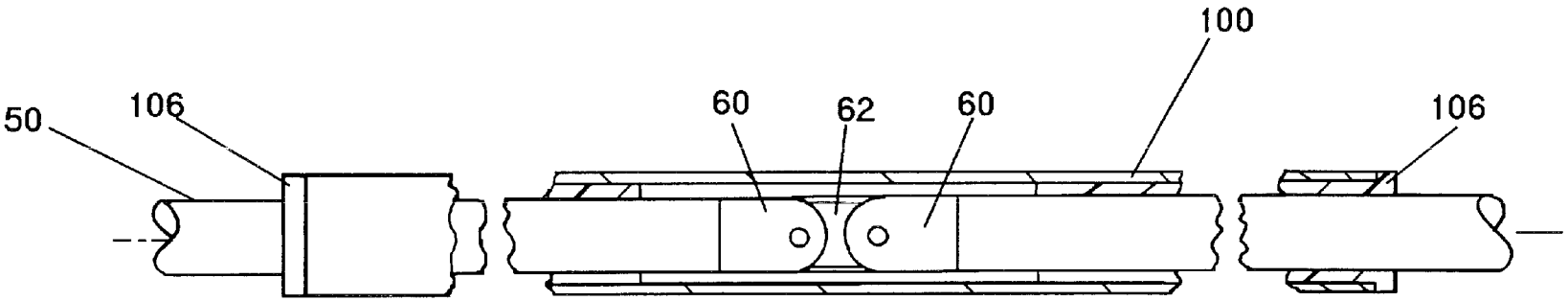
FIG. 7 is a partially section side view of the cross arm coupling assembly.

Referring additionally to FIG. 7, the cross arm assembly 30 comprises a three bar articulated linkage including a pair of outer tubes 50 pivotally connected at inner ends to a swivel coupling assembly 52. An end cap 54 is connected at the outer end of the outer tubes 50. The end cap 54 includes a rounded tip 56 that is received in the counterbore 47 of the sleeve 44.

Referring also to FIGS. 9 through 12, the coupling assembly 52 includes a pair of support links 60 releasably carried at the inner ends of the outer tubes 50 and pivotally connected to a center link 62. Each support link 60 includes a radially expandable cylindrical shank section 64, telescopically received in the inner end of the outer tube 50, and a slotted head section 66.

The shank section 64 includes three equally circumferentially spaced, axially extending, rearwardly opening slots 68 defining outwardly deflectable legs 69. The head section 66 includes a diametrically extending slot 70 defined by a cylindrical base 72 and a pair of spaced arms 74. The base 72 is provided with a counterbore for receiving the head of a hexagonal head fastener 76 having a threaded shank 78 extending axially through the shank section 64. A cylindrical wedge 80 having a rounded tip 82 is threaded onto the shank 78 of the fastener 76. The wedge 80 includes a radially outwardly extending pin 84 aligned with one of the slots 68 in the shank section 64. Accordingly, tightening the fastener 76 draws the wedge 80 into the shank section 64 with the pin 84 guided by and restrained from rotation by the surfaces of the slots 68, thereby outwardly deflecting the legs 69 and effecting locking compressive engagement with the inner surface of the outer tube 50.

The center link 62 includes rounded outer ends received in the slots in the head section 66 conformably between the arms 74. The outer ends are pivotally connected to the arms by parallel, transverse cross pins 86. Pilot holes 88 extend through the outer ends of the center link 62 transverse to the cross pins 86. A rearwardly opening alignment hole 90 is formed in the center of the center link 62 between the cross pins 86 and parallel to the pilot holes 88.

Figure 18:
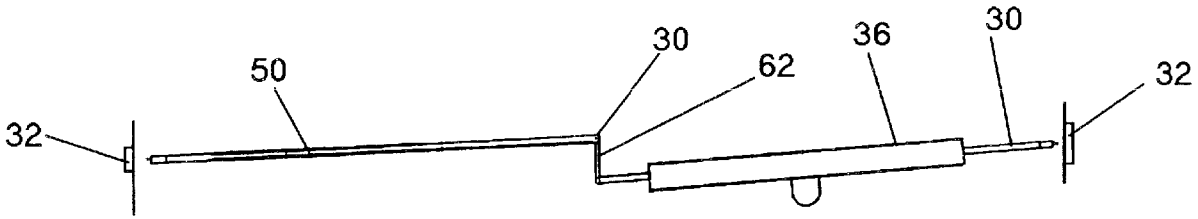
FIG. 18 is a schematic view of the security system prior to installation of the cross bar assembly.
Figure 19:
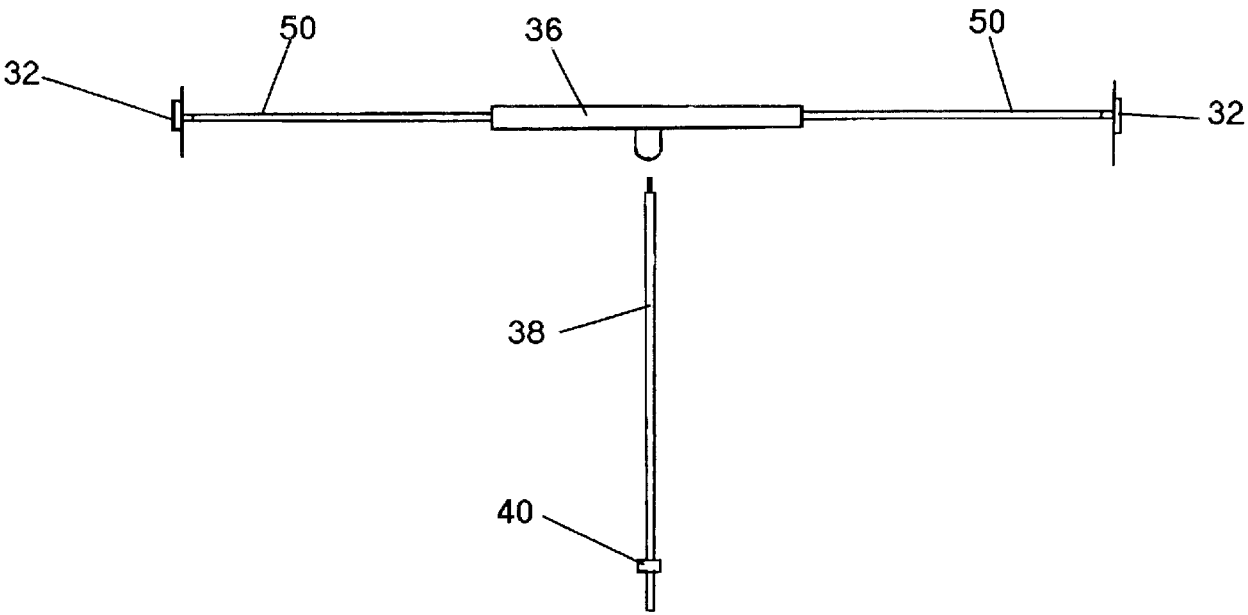
FIG. 19 is a schematic view of the security system in the transverse installed condition prior to connection of the center bar.

Referring to FIGS. 18 and 19, the articulation between the center link 62 and support links 60 permits, with the lock block 36 laterally shifted and disposed outboard thereof, the length of the cross arm assembly 30 to be shortened to a length less that the transverse distance between the mounting brackets 32 for alignment mounting. In locked condition with the outer ends and coupling system coaxially aligned and the lock block 36 centrally disposed thereon, the tips of the cross arm assembly 30 are captured at the mounting brackets 32. For compact unitized storage without disassembly, the outer tubes pivoted about the coupling assembly 52 into juxtaposed position.

Figure 13:
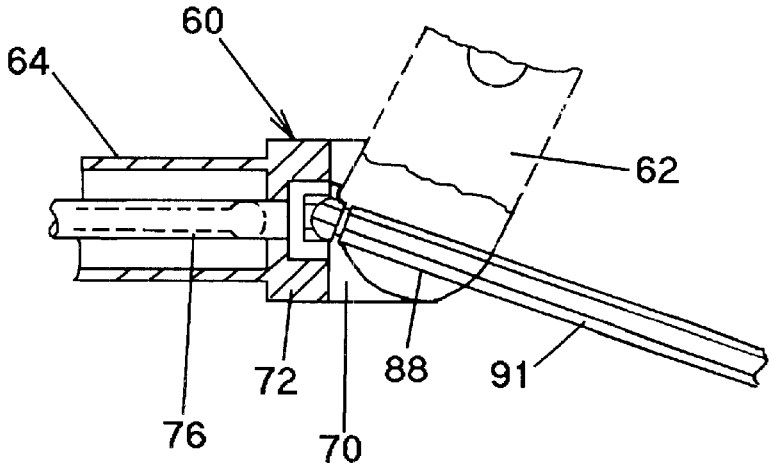
FIG. 13 is a cross sectional view of the removal of the coupling assembly.

Referring to FIG. 13, the coupling assembly 52 is installed and removed from the outer tubes 50 by pivoting the center link 62 until the axis of the pilot hole 88 is aligned with the axis of the fastener 76. A ball end hexagonal wrench 91 is inserted through the pilot hole into engagement with the fastener socket Appropriate rotation of the wrench 91 will accordingly advance or retreat the wedge 80 to effect engagement or release of the shank section 64 and the outer tube 30.

Figure 6:
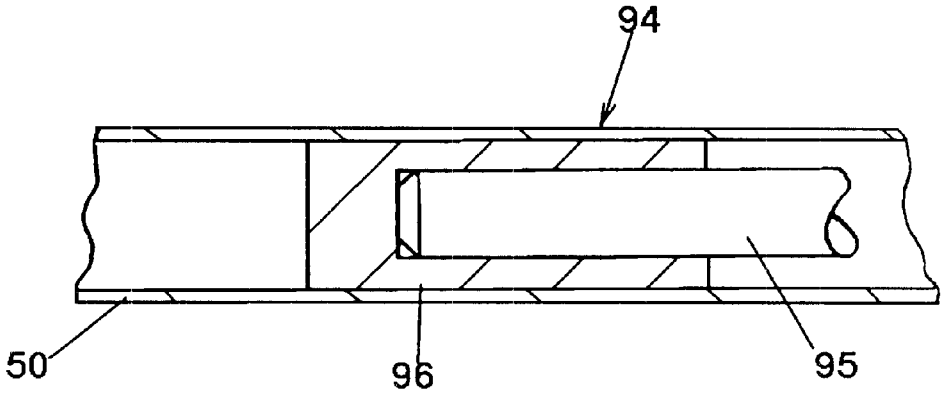
FIG. 6 is a cross sectional view of the roll bar in the cross arm assembly tubes.

Referring to FIGS. 5 and 6, the outer tubes 50 are provided with an interior roll bar assembly 94 for deterring cutting of the components to defeat the security system. Therein, the outer ends of a roll bar 95 are supported by insert bushings 96 slidably retained within the outer tubes. The outer ends of the roll bar 95 are retained within a counterbore in the threaded shank 97 of the end cap 54. The bushings 94 are located, in assembly, within the lateral confines and protection of the lock block 36. Accordingly, if the outer tube is sawed, the inner roll bar 95 will freely rotate to prevent further sawing penetration.

Figure 3:
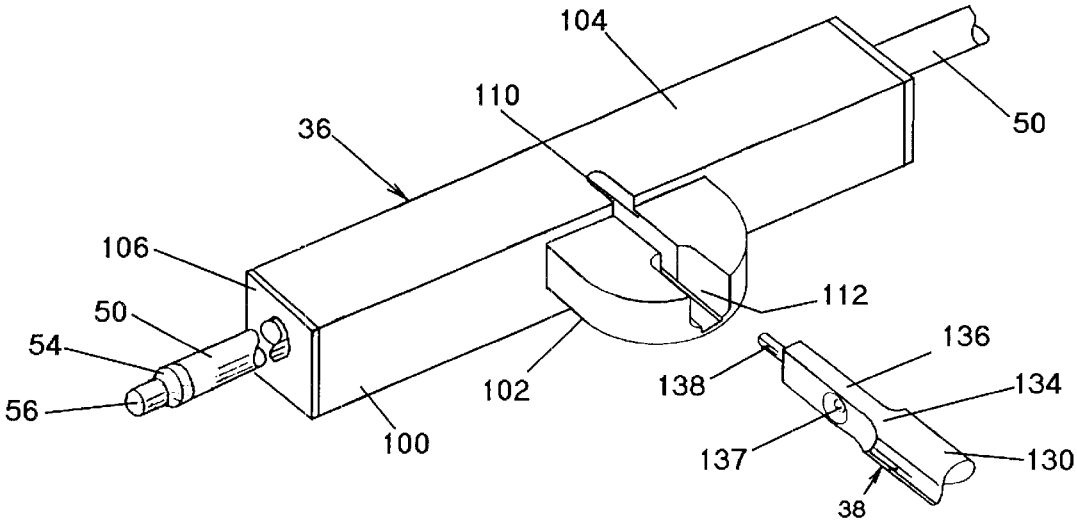
FIG. 3 is a fragmentary perspective view of the security system.
Figure 14:
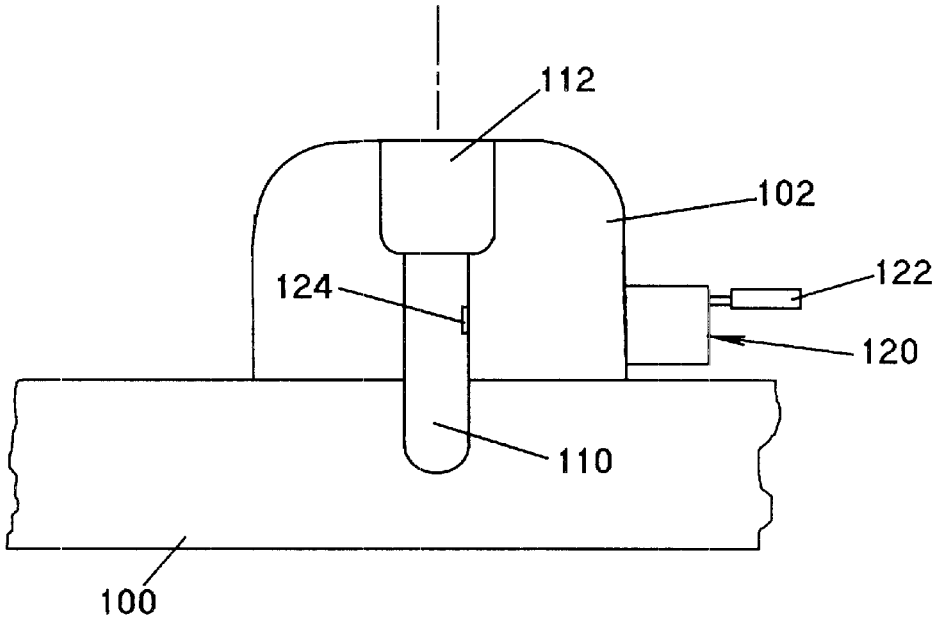
FIG. 14 is a top view of the lock block and hub in the unlocked position.
Figure 15:
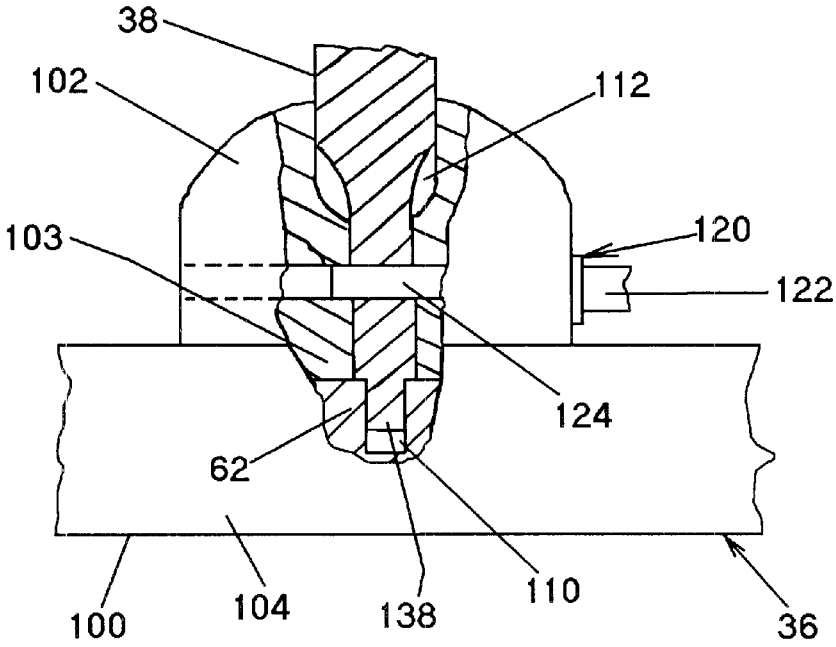
FIG. 15 is a fragmentary partially sectioned view of the lock block hub and the center arm in the locked position.

Referring to FIGS. 3, 14 and 15, the lock block 36 is slidably carried on the outer tubes 50 and coupling assembly 52. The lock block 36 comprises an elongated base tube assembly 100, and a locking hub 102. The base tube assembly 100 includes a rectangular support tube 104 carrying an elongated polymeric bushing 106. The bushing 106 has a central axial bore providing a guided sliding fit for the telescopic translation of the outer tubes 50 and coupling assembly 52 whereby the lock block may be longitudinally translated along the center arm assembly 30.

The locking hub 102 is a generally U-shaped member having a base 103 that is positioned within the support tube through a slot formed in the adjacent wall thereof. The base 103 has a transverse bore coaxially aligned and complementary to the bore in the bushing 106 for providing continuous guiding support of the cross arm assembly. An outwardly opening, vertically upwardly opening medial groove 110 is formed in the hub. A secondary U-shaped groove 112 is formed at the head of the hub and merges the groove 10. A rotary actuated, shiftable lock assembly 120, controlled by a locking key 122 is carried in a transverse bore intersecting the groove 112. In the locked condition, the lock assemble includes a lock bolt 124 that transects the groove 110. As described below, the center arm 38 is conformably received within the grooves 110, 112 and captured by the lock bolt 124 to maintain the locked condition. The lock assembly 120 may take various forms of key activated linear bolt actuation. A commercially available billet type lock is preferred. The lock bolt 124 is operatively coupled to the lock assembly and slidably aligned with the transverse bore. In the unlatched condition, a spring biased lock barrel projects laterally outwardly of the hub 102. With the key 122 inserted into the keyhole, the barrel is depressed to shift the lock bolt 124 to the locked condition. Thereafter, the key 122 is appropriately rotated to maintain the locked position relationships.

Referring to FIGS. 3 and 15, the center arm 38 includes an elongated tubular body 130 terminating with an alignment tip 138. The tip 138 includes a body portion 134 secured to one end of the body 130 and a narrowed neck 136 conformably carried in the grooves 110, 112. The neck 136 includes a transverse hole 137 through which the lock bolt 124 extends in the locked condition. The neck 136 terminates with a projecting, rounded cylindrical nose 138 that is received in the center opening 90 in the center link 62. Thus in the locked condition, the neck of the center bar longitudinally mechanically locks the lock block 36 in fixed longitudinal position on the cross arm assembly, maintaining a rigid coaxial alignment of the outer tubes and coupling assembly to prevent withdrawal thereof from the brackets 32.

Figure 8:
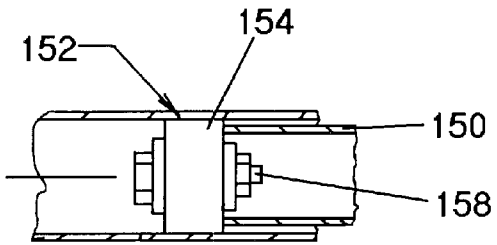
FIG. 8 is a fragmentary side cross sectional view of the roll bar for the center arm.

As shown in FIG. 8, the center arm 38 includes a cylindrical roll bar 150. The roll bar 150 is retained within the center arm 38 between the alignment tip 132 and a radially compressible stop 152 comprising an annular elastomeric disc 154 compressively retained between washers 156 and expanded by fastener 158. The roll bar 150 is rotatable within the center arm 38 for deterring entry through attempted sawing therethrough.

Figure 16:
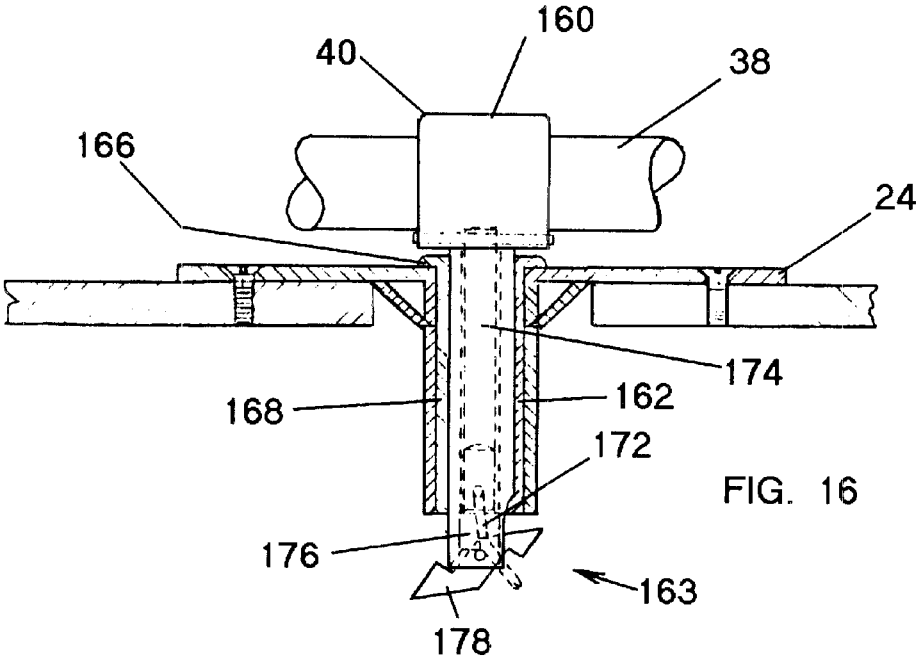
FIG. 16 is a fragmentary side cross sectional view of an embodiment of the anchor spindle.
Figure 17:
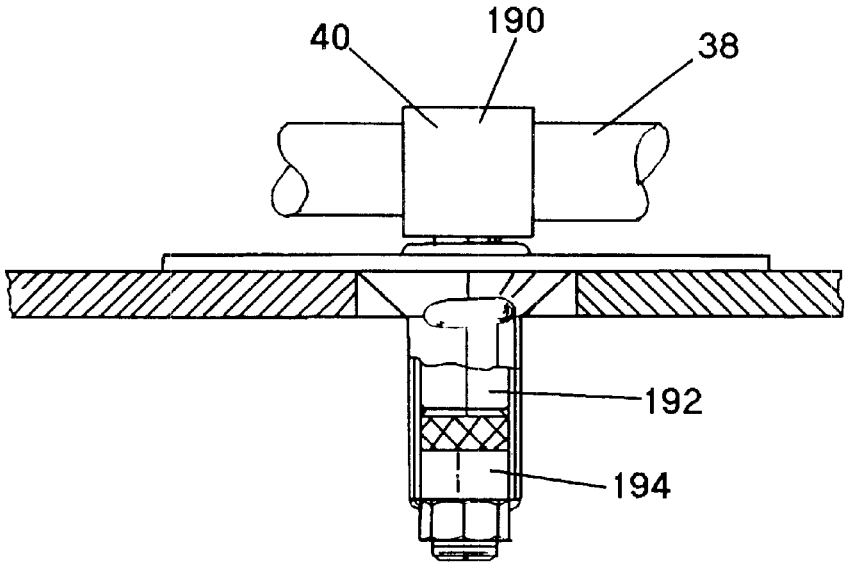
FIG. 17 is fragmentary side cross sectional view of another embodiment of the anchor spindle.

Referring to FIG. 16, the anchor spindle 40 as mentioned above may be incorporated in the pedestal base, as described in detail in the aforementioned application, or as a separately mounted component. The anchor spindle 40 comprises an upper journal body 160 and a lower latching sleeve 162 including a latching assembly 163. The journal body 160 includes a horizontal longitudinal cylindrical passage for telescopically receiving the center arm 38. The journal body 160 includes a lower planar surface for engaging the annular head 166 of the bushing 168. The latching sleeve 162 is rotatably and slidably received in the bushing. The latching assembly 163 comprises a linkage including internal actuating arm 172 carrying a cross pin extending through the passage in the journal body 160 and resides in a lower slot at the bottom of the passage in the latched condition. A generally Z-shaped locking tab 178 is pivotally connected to the body. An axial slot is formed in the lower portion of the body aligned with the tab 178. The tab 178 is rotatable between a vertical insertion position and the illustrated horizontal latched condition. In the unlatched insertion position, the tab 178 is aligned vertically within the envelope of the body permitting insertion of the spindle on the mounting plate. In the latched condition, the tab is transverse to the body and the stop surfaces on the tab 178 project outwardly of the bushing thereby locking the mounting spindle. The tab 178 is shifted between the latched condition and the unlatched condition by actuating linkage. The linkage in the raised position interacts with the tab for vertically orienting the tab. In a lowered position, the linkage rotates the tab to the transverse latched condition to prevent spindle withdrawal. Additionally, the side of the tab portion adjacent one stop surface is larger than the tab portion adjacent the other stop surface. According, by gravitational forces, the tab tends to the transverse position. By manually shifting the cross pin 174, the boat operator can insert the anchor spindle 40 and shift the locking assembly to the lowered position wherein the cross pin 174 resides in the slot 176 and the center arm 38 may be inserted through the journal body preparatory to enabling the security system.

In a further embodiment as shown in FIG. 15, an anchor spindle 190 includes an upper shaft 192 inserted coaxially into pedestal opening. The shaft 192 includes a downwardly projecting threaded shank on which and an eccentrically mounted knurled cam 194 is carried. Upon insertion of the shaft 192 into the pedestal opening and rotation or the spindle 190 into operative position, the cam 194 is driven outwardly into fixed compressive engagement with the sleeve body thereby preventing vertical withdrawal of the spindle 190.

Figure 9:
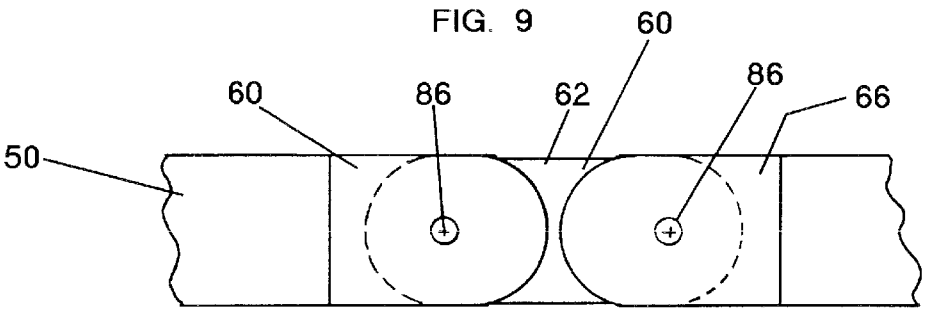
FIG. 9 is a partial side view of the coupling assembly for the cross arm.
Figure 10:
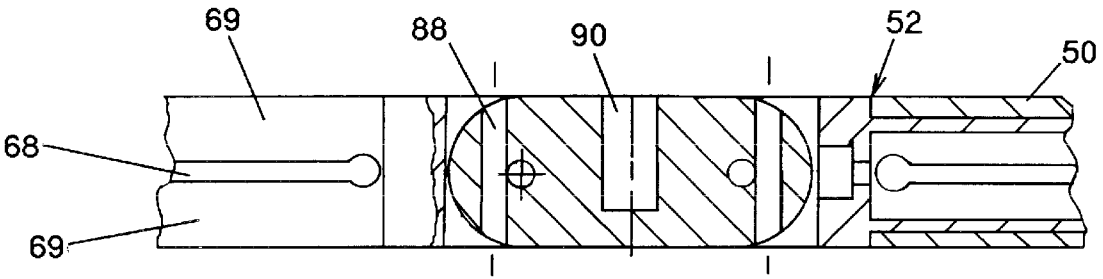
FIG. 10 is a partially sectioned view of the coupling assembly of FIG. 9.
Figure 11:
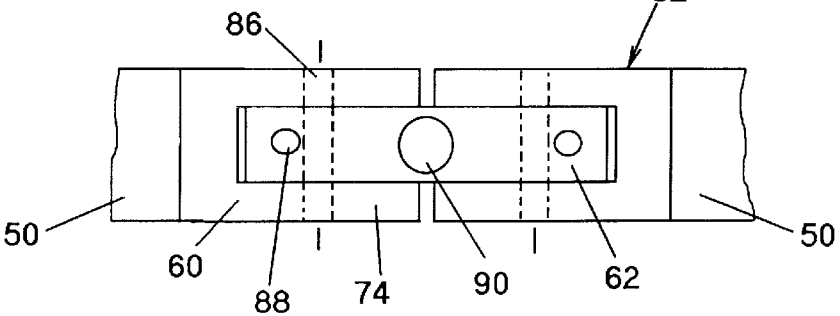
FIG. 11 is a top view of the coupling assembly.
Figure 12:
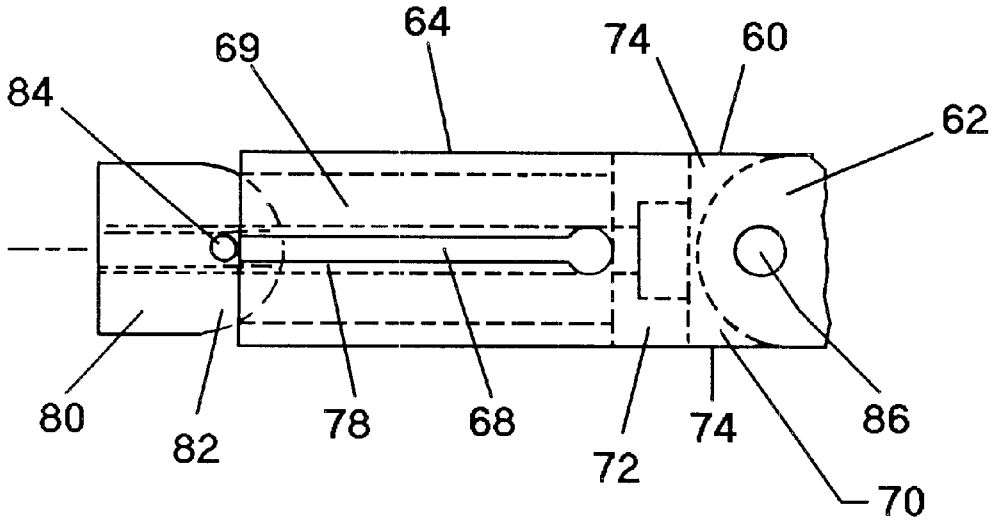
FIG. 12 is a side view of the outer link of the coupling assembly.

For assembling the security system 12 to a particular boat 10, the cross arm assembly 30 is removed from the lock block 36 and the coupling assembly 52 removed from the outer tubes 50. The tubes 50 are transversely oriented in the desired location on the gunnels 18, 20 and the positions scribed for installation of the brackets. The center location for the center bar noted by marking the tubes 50. Outwardly of the center marking the length to the end of the head section of the coupling assembly is marked. The tubes 50 are then cut to length and the coupling assembly 52 reinstalled. The lock block 36 is installed over the center arm assembly. The center arm assembly is shortened as shown in FIG. 8 and aligned with the brackets. The center bar assembly is extended as shown in FIG. 9 for capture by the brackets. Thereafter the lock block 36 centered with the alignment hole 90 in the center link 62 aligned with the grooves in the hub. The center arm 38 is telescoped through the bore in the spindle 40 and the neck 136 disposed in the grooves and the tip 138 inserted into the alignment hole 90 in the center link 62. The lock bolt 124 is actuated through the opening in the neck and latched. According, the articulated components are rigidized, protecting unauthorized entry to the lockers.

Having thus described a presently preferred embodiment of the present invention, it will now be appreciated that the objects of the invention have been fully achieved, and it will be understood by those skilled in the art that many changes in construction and widely differing embodiments and applications of the invention will suggest themselves without departing from the sprit and scope of the present invention. The disclosures and description herein are intended to be illustrative and are not in any sense limiting of the invention, which is defined solely in accordance with the following claims.

What is claimed:

1. A security system for a boat having a pair of gunnels and a seat bracket for a removable seat, said boat having side storage compartments members located adjacent to and between the gunnels and central storage compartment members located between the side storage compartment members, said security system comprising: a mounting bracket for connection with each gunnel and located in opposed transverse relation; a transverse linkage comprising a pair of cylindrical outer arms pivotally connected to a center link, said linkage having a coaxially aligned and extended length for connection said mounting bracket and a shortened length effected by non-axial alignment between said outer arms and said center link for aligning the outer arms with respect to said mounting brackets; a locking member slidably supported on said transverse linkage having a laterally shifted position permitting said shortened length and a locking position effecting and maintaining said extended length; a hub member carried by said locking member; lock means carried by said hub member; central arm for releasable connection at one end with said seat bracket and carried at said hub member at the other end and thereat closely overlying said center storage compartment member; and connector means operative between said hub member and said lock means for fixedly connecting the other end of said center arm to said hub member in a locked condition.

2. The security system as recited in claim 1 wherein said arms are tubular and carry therewithin an rotatable member for deterring severing of said arms.

3. The security system as recited in claim 2 wherein said locking member is includes conformal bushing means for conformingly slidably supporting said outer arms, coaxially aligning said outer arms, and maintaining said extended position.

4. The security system as recited in claim 3 wherein said rotatable member in said outer arms is a solid cylinder.

5. The security system as recited in claim 4 wherein center link is carried in a coupling assembly removably attached to inner ends of said outer arms.

6. The security system as recited in claim 5 wherein said coupling assembly has expandable shanks received within said inner ends of said outer arms for compressive mounting engagement therewith.

7. The security system as recited in claim 6 wherein said coupling assembly includes fastener actuated cam means for outwardly expanding said shanks.

8. The security system as recited in claim 4 wherein an anchor member is slidably connected with said one end of said center bar and includes latching means for releasable connection with said seat bracket.

9. The security system as recited in claim 8 wherein said hub member includes a downwardly opening slot aligned with said seat bracket and said other end of said center arm has a terminal portion slidably received in said slot.

10. The security system as recited in claim 9 wherein said terminal portion includes a transverse hole and said locking means includes a lock bolt engaged with said terminal portion at said transverse hole in said locked condition.

11. The security system as recited in claim 8 wherein said latching means of said anchor member provides a latched condition when operatively associated with said center bar and a unlatched condition when separated from said center bar.

12. The security system as recited in claim 11 wherein said seat bracket includes an apertured support sleeve and said anchor includes a spindle carried by said support sleeve with said latching means engaging said support means in said latched condition for preventing removal of said anchor member from said seat bracket when said center bar is operatively connected therewith.

13. In a marine craft having a plurality of storage lockets carried therein including side lockers located adjacent the sides of the boat and center storage lockers located between said side lockers, and a forward seat pedestal base located transversely between said side lockers and beyond said center lockers, a T-bar security system for preventing access to said lockers in a locked condition comprising: a first mounting bracket mounted on one side of said marine craft and a second mounting bracket mounted on the other side of said marine craft in transverse opposed relation to said first mounting bracket; an articulated linkage having a pair of outer link members pivotally connected at inner ends to a center link member, said link members having a longitudinally aligned extended position connected with said mounting brackets, and a shortened articulated position permitting removal of said linkage from said mounting brackets; and locking means slidably supported on said linkage and slidable to a position overlying said center link member and said inner ends of said outer link members for effecting and maintaining said extended position.

14. A kit for securing storage lockers on a bass boat comprising: a pair of mounting brackets adapted to be connected to the sides of the boat, an articulated linkage comprising a pair of tubular outer arms adapted to attachment at said mounting brackets and independently pivotally connected to a center linkage member; a lock block having an inner bore slidably supporting said outer arms an effecting coaxial alignment thereof in a locking position; a center arm member having a first end coacting with said center linkage member for preventing movement of said lock block from said locking position; connector means selectively engagable with said center arm member for preventing removal thereof; and anchor means for telescopically supporting said center arm member and adapted for releasable attachment to the boat transverse to outer arms.

* * * * *